United States Patent [19]

Crouch et al.

[11] Patent Number: 4,788,814

[45] Date of Patent: Dec. 6, 1988

[54] TEXTILE WINDER EQUIPPED WITH AIR SPLICER AND ATTENDANT METHOD

[75] Inventors: Milton R. Crouch; Paul A. Czelusniak, Jr., both of Eden, N.C.

[73] Assignee: Fieldcrest Cannon, Inc., Eden, N.C.

[21] Appl. No.: 89,743

[22] Filed: Aug. 26, 1987

[51] Int. Cl.[4] ..... D01H 15/00

[52] U.S. Cl. ..... 57/22; 57/261

[58] Field of Search ..... 57/22, 263, 202, 261

[56] References Cited

U.S. PATENT DOCUMENTS

| | | | |
|---|---|---|---|
| 1,986,974 | 1/1935 | Kellogg | 57/22 X |
| 2,605,603 | 8/1952 | Willis | 57/202 |
| 2,705,862 | 4/1955 | Steiger et al. | 57/22 |
| 2,769,599 | 11/1956 | Furst | 242/35.6 R |
| 2,808,356 | 10/1957 | Kimball | 57/202 X |
| 2,844,859 | 7/1958 | Griset | 57/22 X |
| 3,306,020 | 2/1967 | Rosenstein | 57/22 |
| 3,379,002 | 4/1968 | Rosenstein | 57/22 |
| 3,380,135 | 4/1968 | Wood et al. | 57/22 X |
| 3,407,583 | 10/1968 | Irwin et al. | 57/22 |
| 3,461,661 | 8/1969 | Irwin et al. | 57/22 X |
| 3,474,615 | 10/1969 | Irwin et al. | 57/22 X |
| 3,487,618 | 1/1970 | Arguelles | 57/22 |
| 3,526,085 | 9/1970 | Illman | 57/202 |
| 3,634,972 | 1/1972 | Illman | 57/22 |
| 3,643,417 | 2/1972 | Irwin | 57/22 X |
| 4,048,277 | 9/1977 | Breznak et al. . | |
| 4,143,506 | 3/1979 | Pierce | 57/22 |
| 4,229,935 | 10/1980 | Wain | 57/22 |
| 4,397,137 | 8/1983 | Davies et al. | 57/22 |
| 4,437,298 | 3/1984 | Truzzi et al. | 57/22 |
| 4,441,308 | 4/1984 | Rohner et al. | 57/22 |
| 4,444,004 | 4/1984 | Rankin et al. | 57/202 |
| 4,485,615 | 12/1984 | Pigalev et al. | 57/22 X |
| 4,492,076 | 1/1985 | Romic et al. | 57/22 |
| 4,537,019 | 8/1985 | Matsui et al. | 57/22 X |
| 4,667,864 | 5/1987 | Kiteck | 57/22 X |

FOREIGN PATENT DOCUMENTS

| | | | |
|---|---|---|---|
| 145075 | 11/1981 | Japan | 57/22 |
| 956992 | 4/1964 | United Kingdom | 57/22 |
| 2074199 | 10/1981 | United Kingdom | 57/22 |

*Primary Examiner*—Donald Watkins

*Attorney, Agent, or Firm*—Bell, Seltzer, Park & Gibson

[57] ABSTRACT

A textile winder has manually actuatable yarn air splicers mounted on the winder closely adjacent the path of travel of the yarn from its source to the yarn package being wound. The yarn air splicers mainly serve for connecting the yarn from the trailing end of the relatively large package being wound to the leading end of the yarn from the source of supply, such as skeins of yarn carried by a creel.

A yarn end severing means is mounted adjacent each yarn air splicer for severing the ends of the yarn to be spliced so as to obtain substantially coextensive yarn ends for facilitating splicing and obtaining more effective splicing. Manually performed methods of operation of the yarn air splicer and associated yarn end severing means by the winder attendant are also disclosed.

19 Claims, 2 Drawing Sheets

TEXTILE WINDER EQUIPPED WITH AIR SPLICER AND ATTENDANT METHOD

BACKGROUND OF THE INVENTION

This invention relates to joining or connecting textile yarns of a variety of types to each other as the same are being fed from source packages of yarn such as skeins of yarn for forming a relatively large package of yarn on a textile winder. As is well known to those versed in textiles, many smaller packages of yarn serve as a source of supply for forming a single relatively large package of yarn. Thus, it will be appreciated that there are numerous connections of the tail end of yarn from the package of yarn being wound to the leading end of yarn from each of the source packages of yarn in the winding of one relatively large package of yarn therefrom. Typically, such large packages of yarn may be utilized for a variety of purposes, one of which is as source yarns for a textile creel in association with a textile tufting machine for making carpets. Since the yarns on such a tufting machine have to be fed through the eyes of tufting needles, it is important that the connections in the yarn not be of such character or size as to snag in the eyelets of the tufting needles and result in a rupturing or parting of the yarn.

Heretofore, it has been the most common practice for the attendant of such textile winders to manually tie knots in the yarn to connect the trailing end of yarn from the package being wound to the leading end of a source package of yarn. Adhesives have also been used by winder attendants for adhesively splicing the yarns together. Neither of these conventional techniques has been entirely satisfactory since very often a large size of knot results from the manual tying of yarns and has oftentimes presented critical problems in the form of stoppage of textile machines such as tufting machines to which such yarn is fed from the large packages. This has resulted from the snagging of the knots preventing their passage through the eyes of the tufting needles. On the other hand, adhesive has not been commonly used since it is messy to handle and necessitates the winder attendant always carrying a container of adhesive on their body.

While yarn air splicers are also known, they have not been used on textile winders apparently due to their bulky nature, high cost and tedious and time consuming method of operation.

SUMMARY OF THE INVENTION

With the foregoing in mind, it is the primary purpose of this invention to provide with a textile winder having a plurality of side-by-side textile yarn winder stations thereon, air splicers mounted on the winder closely adjacent the paths of travel of the source yarn to the package being wound so that a yarn air splicer is readily available to the winder attendant for connecting the yarns to each other.

It is a further object of this invention to provide an air splicer in association with each running yarn on the textile winder and which air splicer is so positioned and mounted on the winder and so constructed as to be manually actuated by the winder attendant in a relatively easy and simple manner.

It is a further object of this invention to provide in association with each air splicer mounted on the winder, yarn end severing means to facilitate the winder attendant obtaining substantially coextensive ends of the yarn to be spliced prior to being positioned in the air splicer.

It is still a further object of this invention to provide yarn end severing means mounted on a textile winder closely associated with and immediately below each yarn air splicer so that upon the winder attendant effecting the severing of the yarns to obtain substantially coextensive ends thereof, a relatively small movement of the operator's hand is required for positioning the severed ends of the yarn within the yarn air splicer.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE DRAWINGS

Figures 1, 2, 3, 4:
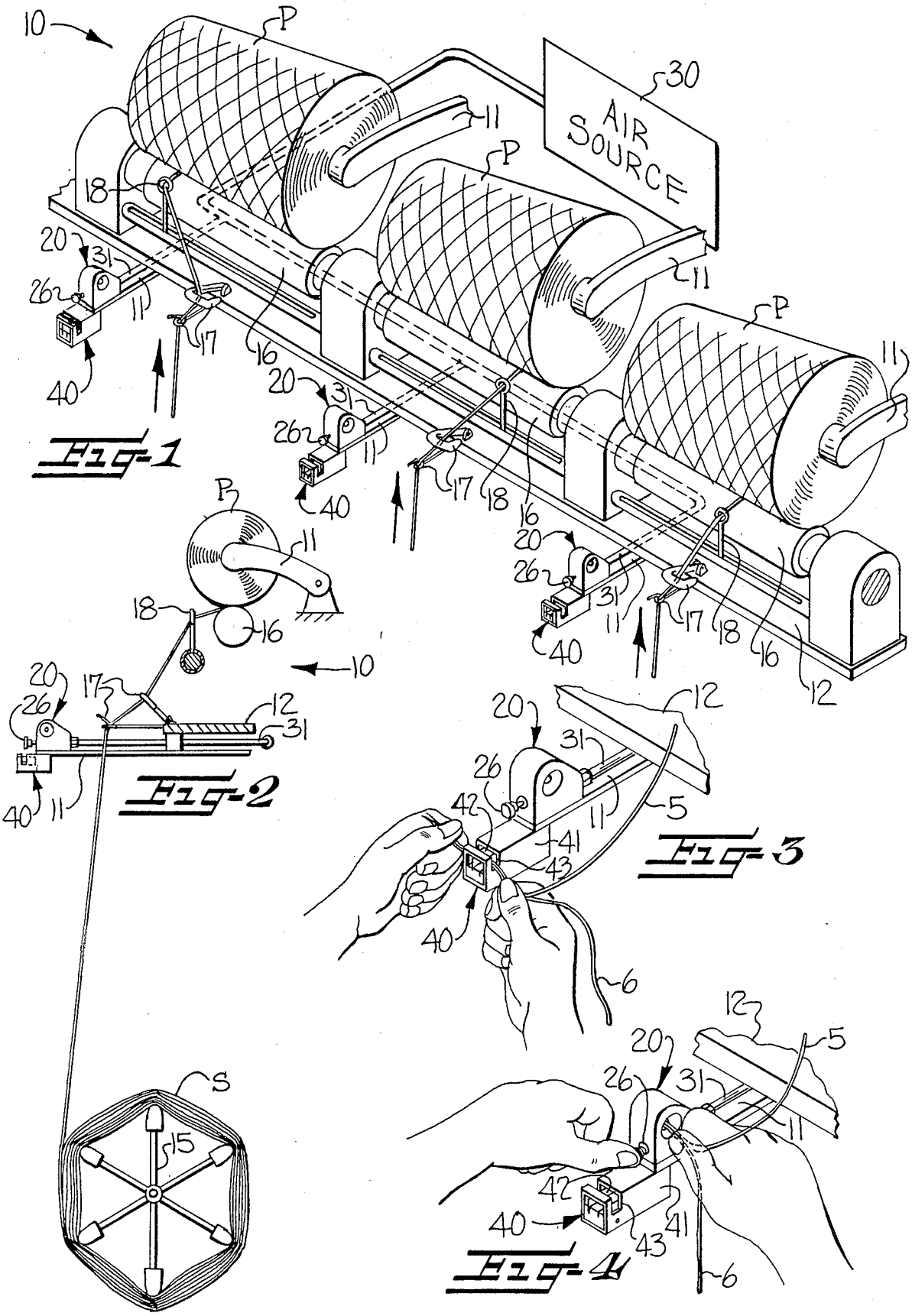
FIG. 1 is a schematic view of a portion of a textile winder shown as being equipped with the yarn air splicer and associated yarn end severing means positioned closely adjacent the path of travel of the source yarns to the respective packages being wound.
FIG. 2 is a schematic view of one winder station and illustrating a reel serving for supplying a source yarn in the form of a skein to the package being wound and wherein the yarn air splicer and associated yarn end severing means are illustrated alongside the path of travel of the yarn.
FIG. 3 is a fragmentary schematic view of a yarn air splicer and associated yarn end severing means and illustrating the manner in which the winder attendant would effect severing of the ends of the yarn prior to air splicing.
FIG. 4 is a view similar to FIG. 3, but illustrating the next step following the severing of the yarn ends wherein the operator positions the coextensive severed ends of yarn in the air splicer with the right hand and the thumb of the left hand is shown manually actuating the air splicer.

Referring now specifically to the drawings and particularly to FIGS. 1–4 as illustrated in the first sheet of drawings, a textile winder 10 is schematically illustrated and wherein a plurality of packages of yarn P are shown being wound by yarn being fed from a source S illustrated in the form of a skein of yarn carried by a creel 15 positioned below the packages P. Suitable yarn guides 17 are provided for guiding the yarn from the creels 15 to the packages P and wherein a traverse member 18 is associated adjacent each of the packages being wound for controlling the wind of the yarn on the packages. As illustrated, the packages P are shown as being rotably carried by conventional pivoted arms 11 with the packages P resting against a drive drum 16 for imparting of rotation to the packages on the arms 11.

As illustrated, a yarn air splicer broadly indicated at 20 is provided for each of the running yarns forming the packages P, with each air splicer 20 being connected to a suitable source of pressurized air 30 through connecting pipes 31. Each of the air splicers 20 is suitably mounted on the winder as by being carried by respective plates 11 connected to frame 12 of the winder 10. It should be noted that the yarn air splicers 20 are positioned closely adjacent the running path of the yarn from the supply creels 15 to the packages P being formed. Each of the air splicers has yarn severing means 40 associated therewith for severing the ends of the yarn substantially coextensive prior to being air spliced. In this regard, it will be understood that by having the ends of yarn to be spliced substantially coextensive with each other more effective air splicing of the yarn is obtained. The yarn severing means 40 is shown positioned immediately forwardly of and just below the yarn air splicers 20, all as best illustrated in FIGS. 1, 3 and 4 of the drawings.

Figure 7:
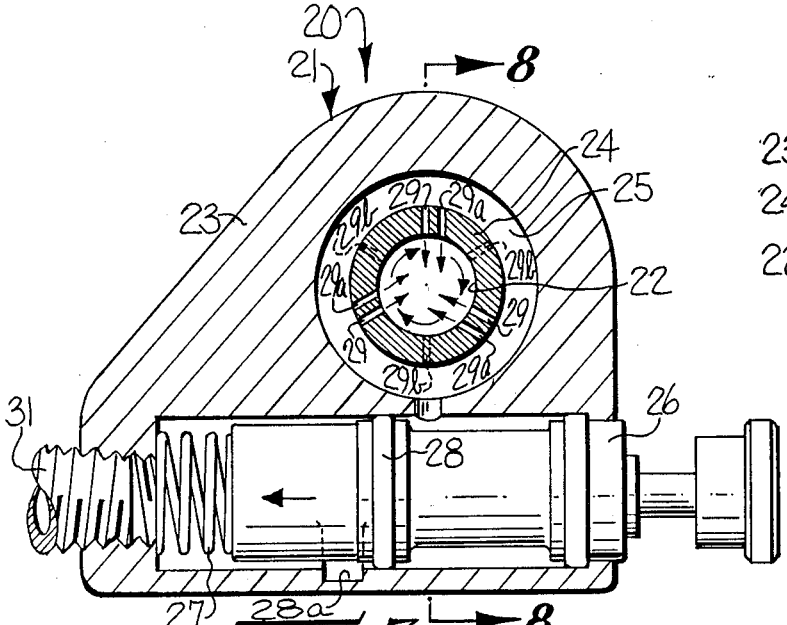
FIG. 7 is a transverse vertical sectional view of the yarn air splicer as shown in FIG. 1 and schematically illustrating the inner working components thereof.
Figure 8:
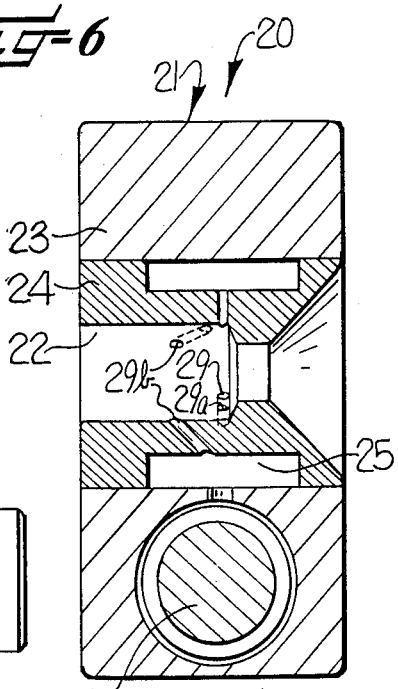
FIG. 8 is a vertical sectional view taken along line 8—8 of FIG. 7 for further illustrating the inner passageway and associated structural features of the air splicer.
Figure 9:
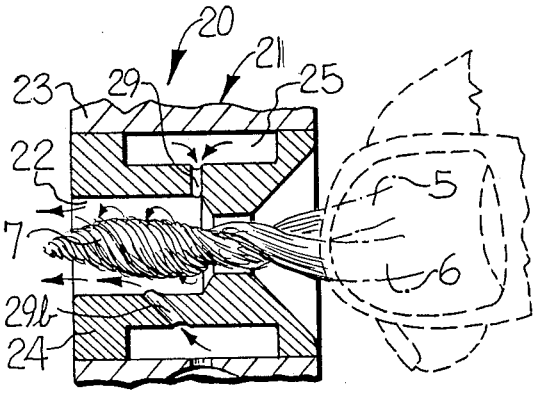
FIG. 9 is a detailed view of the central portion of FIG. 8 and illustrating, in dotted line, ends of yarn positioned therein for being air spliced.

Referring now to the details of the yarn air splicer 20, and referring particularly to FIGS. 7–9, it will be noted that a relatively small housing 21 is provided and through which housing an air passageway 22 extends and in which passageway the ends of the yarn to be spliced are placed as best illustrated in FIGS. 4 and 9. The housing 21 comprises an outer wall 23 and an inner wall 24 defining an air chamber 25 therebetween and which chamber is communicatively connected to the source 30 of pressurized air when the air splicer is manually actuated by the operator depressing a valve plunger or sliding valve member 26. As illustrated, a spring 27 is positioned in opposition to the movement of the sliding valve member 26 to normally prevent the air from passing into the air splicer 20. However, upon the plunger 26 being manually actuated as by the thumb of the winder attendant as illustrated in FIG. 4, preferably prior to the ends of yarn being placed in the air passageway 22, the movement of the plunger 26 in opposition to the spring will cause a sealing member in the form of an O-ring 28 to move into an enlarged cavity **28*a* forwardly thereof (see FIG. 7) to thus permit the compressed air to then flow around the O-ring into the passageway 22**.

As best illustrated in FIG. 7–9, the air splicer housing 21 has a first series of openings 29, **29*a* for compressed air extending through inner wall 24 of the housing and communicating with the air chamber 25 therebetween. The series of openings 29, 29*a* are circularly arranged as best illustrated in FIG. 7 so as to direct air from a plurality of directions into the passageway 22 for effecting air entanglement of the ends of the yarn therein. As shown in FIG. 7 the circularly arranged openings 29, 29*a* are each three in number and arranged in adjacent pairs of one opening of each type. The openings 29 are positioned on the radius of the passageway 22 and cause entanglement of the yarn components, while the openings 29*a*** are offset from the radius to impart twist to the yarn splice being formed.

A second series of openings **29*b* are also provided extending through the inner wall 24 and also communicating with air chamber 25. This second series of openings 29*b* are positioned further away from an inlet end I of the passageway 22 than the first mentioned series of opening 29, 29*a* and thus are positioned further downstream of the first mentioned series of openings 29, 29*a*. It will be noted as best illustrated in FIG. 9 that the openings, 29*b* forming the second series of openings are inclined at an angle oriented toward the exit end E of the passageway 22** so that a suction effect is created in the passageway to draw the ends of the yarn therein.

Referring now to the operation of the yarn air splicer 20 and the manner in which the same is used in conjunction with the yarn end severing means 40 for severing the ends of the yarn substantially coextensive with each other, attention is again directed to FIGS. 3 and 4. It will be noted that ends of yarn 5 and 6 are shown as being positioned in the yarn end severing means 40 for severing the ends of yarn by the operator holding the ends of yarn beside each other and both facing in a common direction between the attendant's right and left hands. Held in this manner, the ends of yarn 5, 6 are then positioned within slot 43 of the yarn end severing means 40 and a downward movement is imparted to the operator's left hand which causes the ends of the yarn to be moved across upstanding blade 42 to sever both ends of the yarn. Now the operator moves the right hand towards air splicer 20 and inserts the severed ends of yarn in the yarn air splicer after first actuating the air splicer by depressing knob 26 to cause the valve to be slidably moved inwardly and to cause compressed air to flow into passageway 22. As stated before, the flow of compressed air into the passageway 22 causes the ends of the yarn to be intimately entangled with each other and to form a commingled projection 7 (see FIGS. 10 and 11) of entangled fiber components extending laterally from the body of the yarn. Thus, it will be understood that the accessibility of the yarn air splicer 20 and attendant yarn end severing means 40 for severing the ends of yarn coextensive with each other, readily permits the operator to quickly air splice the trailing end 5 of yarn extending from the packages P to the leading yarn end 6 of the source yarns S to quickly restore the winding of the yarn packages P. It will further be understood that by having the yarn air splicers 20 and the yarn end severing means 40 located in upper regions of the winder, that no additional stooping by the winder attendant is necessitated in utilizing this invention in conjunction with the textile winder.

Figure 5:
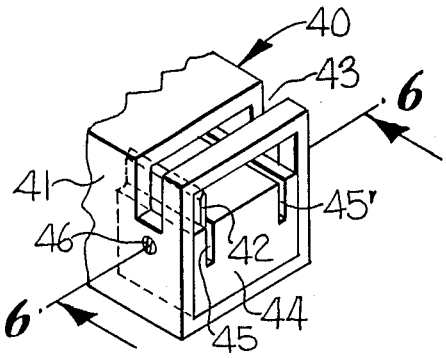
FIG. 5 is an enlarged fragmentary detail of the yarn end severing means.
Figure 6:
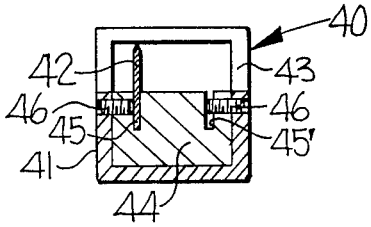
FIG. 6 is a transverse vertical sectional view taken along line 6—6 of FIG. 5.

Referring now to more of the details of the yarn end severing means 40, as best shown in FIGS. 5 and 6, a tubular body member 41 is provided with the upright blade 42 confined therein adjacent one side of the tubular member and extending longitudinally thereof. The slot 43 communicating with blade 42 extends across upper portions of the tubular member 41 and across the blade 42, with the depth of the slot 43 being such as to extend below the sharp upper edge of the blade 42 whereby yarn to be spliced may be manually placed in the slot beside each other so that their ends may be severed by downward movement across the blade 42. To maintain the blade 42 in an upright position and within the tubular number 41, a blade mounting block 44 is positioned inside member 41 and held therein by opposing screws 46 extending through opposed threaded openings in the sides of tubular member 41. Also the screws 46 serve the dual purpose of engaging the upright blade 42 to hold the same within a slot 45 provided in the mounting block 44. An additional slot 45' is provided in the event the yarn severing means 40 is to be used by left handed winder attendants, in which event the blade 42 would be mounted in slot 45'. Desirably in such an event, the air splicer 20 would be facing in an opposite direction from that illustrated in the drawings.

Figure 10:
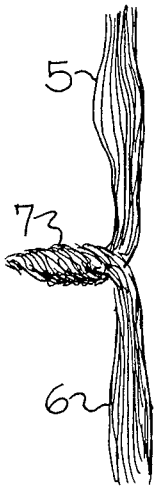
FIG. 10 illustrates an air spliced yarn wherein the ends of the yarn have been subjected to the air turbulences of the air splicer to effect an entanglement of the fiber components of the ends of the yarn with each other and to form a commingled projection of entangled fiber components extending laterally from the spliced yarn which is shown as being a textured yarn.
Figure 11:
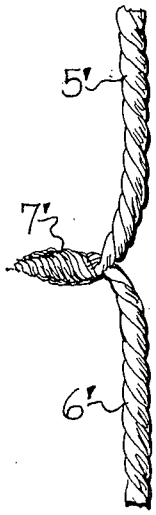
FIG. 11 is a similar view as FIG. 10, but schematically illustrating the spliced yarn as being a spun plied yarn.

As earlier indicated, the air splicer 20 of this invention forms a unique air splice in that the ends 5, 6 of the yarn to be spliced are positioned beside each other and extending in a common direction as opposed to conventional air splicers wherein the ends of the yarn are facing in opposite directions beside each other instead of in a common direction. Further, it will be appreciated that by having ends of the yarn to be spliced substantially coextensive through use of the yarn end severing means 40, that a more effective splice is formed in the yarn which exhibits itself as illustrated in FIGS. 10 and 11 as a commingled projection 7 of the entangled fiber components.

This invention may be used with a wide variety of textile yarns including spun yarns formed of staple fibers, as well as filament yarns which are so common today particularly textured filaments. It has been found that the splice formed in the yarns by the air splicer 20 of this invention is sufficiently strong that no problem of separation of yarn ends has been encountered with the proper use of the air splicer. Subsequent handling of such yarns in forming textile fabrics and the like therefrom has confirmed the strength and advantage of such yarn splices in practice.

It will thus be seen that the textile winder equipped with the yarn end air splicer and associated yarn end severing means of this invention permits the winder attendant to obtain a yarn splice in a very simple manner and thus serving to encourage winder attendants to use this new technology instead of prior practices and their associated shortcomings as noted earlier.

That which is claimed:

1. A method of winding a relatively large package of yarn on a textile winder from a plurality of smaller source packages of yarn such as skeins of yarn, said method comprising air splicing the tail end of the package of yarn being wound to the leading end of a source package of yarn by placing the tail and leading ends of the yarns in an open-ended confined passageway of an air splicer mounted on the winder closely adjacent the path of travel of the source yarn to the package being wound, with the ends of the yarns in the passageway being beside each other and facing in a common direction, and subjecting the ends of the yarns while within the passageway to air turbulences to effect an entanglement of the fiber components of the ends of the yarn with each other and to impart twist to the entangled ends of the yarn so as to form a twisted commingled projection of entangled fiber components extending laterally from the spliced yarns.

2. A method according to claim 1 wherein the textile yarns being spliced are spun yarns and the fiber components being entangled are staple fibers.

3. A method according to claim 1 wherein the textile yarns being spliced are multifilament yarns and the fiber components being entangled are filaments.

4. A method according to claim 1 wherein the textile yarns being spliced are multifilament textured yarns and the fiber components being entangled are filaments.

5. A method according to claim 1 wherein the textile winder has a plurality of packages of yarn being wound, and wherein the method further comprises mounting an air splicer on the winder closely adjacent the path of travel of each of the source yarns to the corresponding package of yarn being wound therefrom so as to have air splicers readily accessible to the winder attendant for each yarn being wound.

6. A method according to claim 1 or 5 including, prior to air splicing, placing the leading and trailing ends of yarn beside each other and severing residual end portions thereof so as to have substantially coextensive ends of yarn for facilitating air splicing.

7. A method according to claim 5 including mounting a yarn end severing means on the winder closely adjacent each air splicer for facilitating the winder attendant obtaining substantially coextensive ends of yarn for splicing.

8. A textile winder having a yarn package winding station, a source yarn supply station, and a manually actuatable air splicer for ends of yarn mounted on the winder closely adjacent the path of travel of the source yarn from said winding station, said air splicer being adapted to splice the tail end of yarn from the yarn package being wound to the leading end of the source yarn from said supply station, said air splicer comprising a housing having an inlet end and an exit end, the inlet end serving to receive ends of yarn to be spliced with the ends of yarn being positioned beside each other and facing in a common direction in the inlet end, the exit end serving for exhaust of the compressed air, said housing having inner and outer walls defining an air chamber therebetween into which the compressed air is directed, and a series of openings for compressed air extending through said inner wall and communicating with said air chamber and said passageway for effecting air entanglement of the ends of yarn positioned in the passageway and for twisting of the air entangled ends of yarn with each other.

9. An apparatus according to claim 8 including yarn end severing means mounted on said winder adjacent said air splicer to facilitate obtaining the ends of the yarn substantially coextensive prior to being positioned in the inlet end of said passageway for being spliced.

10. An apparatus according to claim 9 wherein said yarn end severing means comprises an upright blade.

11. An apparatus according to claim 9 wherein said yarn end severing means comprises a body member having a yarn slot therein, and an upright blade adjacent one end of said slot, said blade having a sharp upper edge and downwardly and across which edge the winder attendant may move the ends of the yarn to effect severing of residual end portions thereof.

12. An apparatus according to claim 9 wherein said yarn end severing means comprising a substantially horizontally disposed tubular member extending forwardly from upper portions of said winder, an upright blade mounted within the confines of said tubular member and extending lengthwise of said tubular member adjacent one side thereof, said blade having a sharp upper edge, and a transverse yarn slot extending across upper portions of said tubular member and across said blade, and the depth of said yarn slot being such as to extend below the sharp upper edge of said blade whereby yarns to be spliced may be manually placed in the slot beside each other so that their ends may be severed by being moved downwardly across the blade to thus obtain substantially coextensive yarn ends prior to splicing.

13. An apparatus according to claim 8 or 9 including a second series of openings extending through said inner wall and also communicating with said air chamber and said passageway and positioned further away from said inlet end of said passageway than said first mentioned series of openings and thus being downstream of said first mentioned series of openings, and said second series of openings being inclined at an angle oriented toward the exit end of said passageway so that a suction effect is created in the passageway to draw the ends of the yarns therein.

14. A textile winder having a plurality of side-by-side textile yarn winder stations and each comprising a yarn package winding station and a source yarn supply station, means providing pressurized air at each winder station, and a plurality of spaced apart manually actuatable air splicers for yarns connected to said pressurize air means and each mounted on the winder closely adjacent a respective path of travel of the source yarn from said supply station to a package being wound at said package winding station, each air splicer being adapted to splice the tail end of yarn from the yarn package being wound to the leading end of the source yarn from said supply station, said air splicer comprising a housing having an inlet end and an exit end, the inlet end serving to receive ends of yarn to be spliced with the ends of yarn being positioned beside each other and facing in a common direction in the inlet end, the exit end serving for exhaust of the compressed air, said housing having inner and outer walls defining an air chamber therebetween into which the compressed air is directed, and a series of openings for compressed air extending through said inner wall and communicating with said air chamber and said passageway for effecting air entanglement of the ends of yarn positioned in the passageway.

15. An apparatus according to claim 14 including yarn end serving means mounted on said winder adjacent each of said air splicers to facilitate obtaining the ends of the yarn substantially coextensive prior to being positioned in the inlet end of said passageway for being spliced.

16. A apparatus according to claim 15 wherein said yarn end severing means comprises an upright blade.

17. An apparatus according to claim 15 wherein said yarn end severing means comprises a body member having a yarn slot therein, and an upright blade adjacent one end of said slot, said blade having a sharp upper edge and downwardly and across which edge the winder attendant may move the ends of the yarn to effect severing of residual end portions thereof.

18. An apparatus according to claim 15 wherein said yarn end severing means comprises a substantially horizontally disposed tubular member extending forwardly from upper portions of said winder, an upright blade mounted within the confines of said tubular member and extending lengthwise of said tubular member adjacent one side thereof, said blade having a sharp upper edge, and a transverse yarn slot extending across upper portions of said tubular member and across said blade, and the depth of said yarn slot being such as to extend below the sharp upper edge of said blade whereby yarns to be spliced may be manually placed in the slot beside each other so that their ends may be severed by being moved downwardly across the blade to thus obtain substantially coextensive yarn ends prior to splicing.

19. An apparatus according to claim 14 or 15 including a second series of openings extending through said inner wall and also communicating with said air chamber and said passageway and positioned further away from said inlet end of said passageway than said first mentioned series of openings and thus being downstream of said first mentioned series of openings, and said second series of openings being inclined at an angle oriented toward the exit end of said passageway so that a suction effect is created in the passageway to draw the ends of the yarns therein.

* * * * *